US006234862B1

(12) United States Patent
Wittenberg

(10) Patent No.: US 6,234,862 B1
(45) Date of Patent: May 22, 2001

(54) ANIMAL TOY HAVING SIMULATED LIQUID DRINKING AND WETTING ACTION

(75) Inventor: Mark Wittenberg, Anaheim, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/632,334

(22) Filed: Aug. 3, 2000

(51) Int. Cl.[7] ..... A63H 3/24
(52) U.S. Cl. ..... 446/305
(58) Field of Search ..... 446/296, 305

(56) References Cited

U.S. PATENT DOCUMENTS

| | | | |
|---|---|---|---|
| 2,907,139 | 10/1959 | Rekettye . | |
| 3,745,696 | 7/1973 | Sapkus et al. . | |
| 3,959,919 | 6/1976 | Baulard et al. . | |
| 4,151,675 | 5/1979 | Juan . | |
| 4,160,338 | 7/1979 | Lyons et al. . | |
| 4,439,162 | 3/1984 | Blaine | 434/268 |
| 4,443,200 | 4/1984 | Murphy | 434/247 |
| 5,083,965 | 1/1992 | Mayem | 446/305 |
| 5,254,028 | 10/1993 | Liao | 446/297 |
| 5,509,808 | 4/1996 | Bell | 434/247 |
| 5,941,750 | 8/1999 | Pracas | 446/130 |
| 6,033,229 | 3/2000 | Scherman et al. | 434/267 |

*Primary Examiner*—John A. Ricci
(74) *Attorney, Agent, or Firm*—Roy A. Ekstrand

(57) ABSTRACT

A toy figure resembling a four-legged animal includes a resilient body having a back portion and a head defining a mouth passage. A liquid filled bottle is insertable into the mouth of the figure to transfer liquid into the interior of the figure. A single direction flow valve couples the transferred liquid from the mouth through a throat housing and ultimately into a resilient liquid bladder supported within the body of the toy figure. The toy figure body further supports a discharge valve coupled to a downwardly open discharge port which is operated by a vertically extending actuating rod supported within the bladder. The actuating rod and discharge valve as well as the discharge port define communicating passages which provide an air vent for the bladder during filling. A quantity of liquid is discharged downwardly through the discharge port by pressing upon the toy figure body with sufficient force to depress the actuating rod and open the discharge valve.

7 Claims, 2 Drawing Sheets

ANIMAL TOY HAVING SIMULATED LIQUID DRINKING AND WETTING ACTION

FIELD OF THE INVENTION

Figure 3:
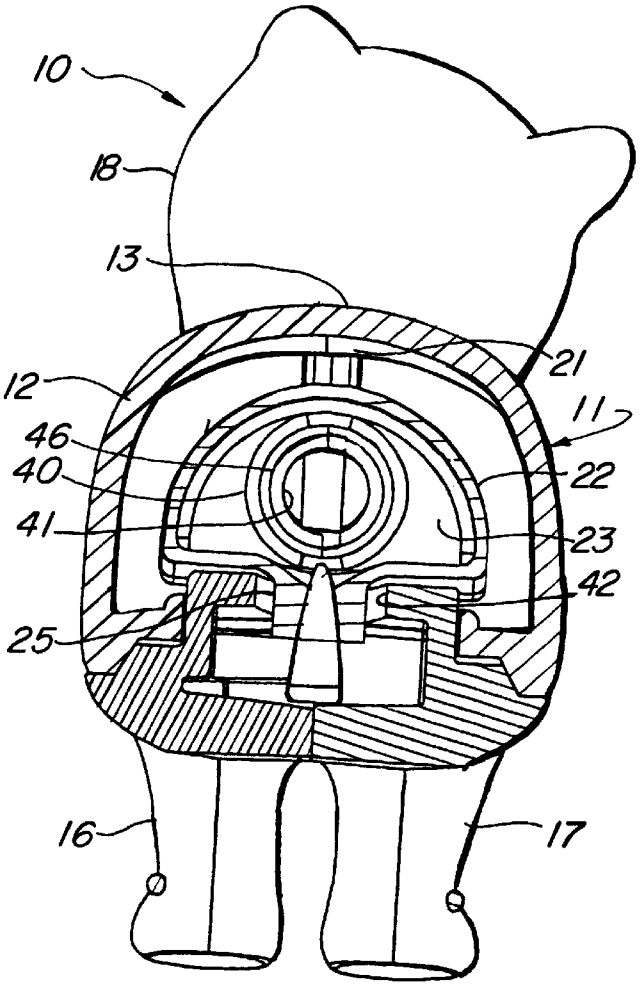

This invention relates generally to dolls and toy figures and particularly to dolls and toy figures providing a drinking and wetting action.

BACKGROUND OF THE INVENTION

Toy figures and dolls are well known in the art and have been provided in virtually endless variety for many years. Among the many types of toy figures and dolls known in art, many include operative mechanisms which cause the toy figure or doll to simulate certain basic functions such as eating, walking, crawling, crying and the like. One type of function simulating toy figure and doll which has received substantial attention in the art may be generally described as a "wetting" toy figure or doll.

While toy figures and dolls having a wetting action have been provided in a considerable variety, all may be generally understood to include the same general apparatus. This general apparatus typically includes some mechanism for intake of a liquid, usually water, together with an internal reservoir within the toy figure or doll for storing a quantity of the water intake and a mechanism for controlled discharge of the liquid from the internal reservoir to simulate the wetting action.

For the most part, wetting dolls which generally resemble human infants form the most numerous and common type of wetting doll. However, toy figures which provide a simulated wetting feature are known in the art which often resemble animal figures.

For example, U.S. Pat. No. 5,254,028 issued to Liao sets forth a FLUID RELEASING AND SOUND GENERATING TOY having a body generally resembling a dog within which a container for receiving a fluid and maintaining the fluid under pressure is supported within the doll body. An electric valve is operatively coupled to the pressurized container for releasing liquid therefrom. A sound generating unit and a receiving circuit cooperate with a controller unit to facilitate discharge of the pressurized liquid from the container through operation of the valve. The valve operation is triggered by controller action responsive to a pressure sensitive switch disposed in the nose of the toy figure The controller further operates the sound generating unit to provide sound in accompaniment to the release of pressurized liquid.

Typical wetting dolls are found in many patents such as U.S. Pat. No. 2,907,139 issued to Rekettye which sets forth a WEEPING, CRYING AND WETTING DOLL having a doll having a body, appendages and head generally resembling a human infant. The head defines a mouth having a passage extending inwardly therefrom which provides liquid communication with the doll interior. A reservoir is disposed within the doll head for receiving and holding liquid. The reservoir is further coupled to a discharge orifice at the lower end of the doll torso. The holding mechanism within the doll is operative to provide discharge of liquid through the discharge orifice in the doll torso when the doll is positioned in a prone position.

U.S. Pat. No. 3,959,919 issued to Baulard-Cogan sets forth ANIMATED OBJECTS SUCH AS DOLLS, FIGURED PERSONAGES AND THE LIKE having a deformable flexible envelope mounted on a rigid casing filling the greater part of the head and trunk portions of the doll. The mouth of the doll is moved by actuating means causing nursing of the doll and permitting absorption and excretion of liquid.

U.S. Pat. No. 4,151,675 issued to Guan sets forth DOLLS THAT SIMULATE PHYSIOLOGICAL FUNCTIONS having a doll defining a doll body and head. The head includes a mouth aperture coupled to a plurality of conductive tubes extending inwardly through the doll head to a reservoir supported with the doll body. The reservoir receives liquid from the mouth and deforms when pressure is applied to the doll body causing water to be discharged from the reservoir to a discharged tube simulating wetting function.

U.S. Pat. No. 4,160,338 issued to Lyons et al sets forth a SOUND EMITTING AND WETTING DOLL having a toy doll body and head which in turn includes a mouth opening adapted to receive a simulated nursing bottle. An internal bellows mechanism is configured to produce a sound device which creates a burping sound when the doll back is patted. The operation of the sound producing device also causes liquid to be emitted from the doll body.

U.S. Pat. No. 5,083,965 issued to Mayem sets forth an INTERACTIVE DOLL SYSTEM which includes both liquid handling elements for receiving liquid through the doll mouth in one position and dispensing liquid through the eyes when the doll is in a second position. Alternatively, water is dispensed through an anal opening of the doll when the doll is in a third position. An electronic assembly within the doll senses the position or attitude and motion of the doll as well as the feeding thereof for creating a range of sounds in response thereto.

U.S. Pat. No. 5,941,750 issued to Pracas sets forth a DOLL HAVING MAGNETICALLY ACTUATED FUNCTIONS capable of simulating physiological functions of a human body in response to an applied magnetic field. The doll includes an internal reservoir which may be filled with fluid through the doll mouth. The internal reservoir which has an outlet which is closeable by a closure member. The closure member is movable from a closed position to an open position in which the outlet is opened in response to an applied magnetic field. A cooperating cot is utilized which includes a magnet operative to energize or activate the closure member when the doll is placed on the cot. The proximate position of the doll closure member and the magnetic with the cot causes the closure member to open and allows the doll to wet.

U.S. Pat. No. 6,033,229 issued to Sherman et al, U.S. Pat. No. 4,443,200 issued to Murphy and U.S. Pat. No. 5,509,808 issued to Bell set forth various toilet training devices having similar structures to the above described wetting dolls and generally related to the art to which the present invention pertains.

U.S. Pat. No. 4,439,162 issued to Blaine sets forth a TRAINING MANIKIN FOR MEDICAL INSTRUCTION while U.S. Pat. No. 3,745,696 issued to Sapkus et al sets forth a DOLL HAVING MEANS FOR CHANGING FACIAL EXPRESSION UPON TURNING OF HEAD.

While the foregoing described prior art devices have to some extent improved their respective arts and have in some instances enjoyed commercial success, there remains nonetheless a continuing need in the art for improved, more interesting and amusing toy figures having drinking and wetting functions.

SUMMARY OF THE INVENTION

Accordingly, it is a general object of the present invention to provide an improved and more amusing toy figure. It is a more particular object of the present invention to provide an improved and more amusing toy figure which includes a novel mechanism for producing or creating a simulated drinking and wetting effect.

In accordance with the present invention there is provided a toy figure comprising: a deformable toy figure body having a head defining a mouth aperture and mouth passage and having a body interior cavity; an internal liquid bladder supported within the body interior cavity; means for coupling the mouth passage to the liquid bladder; a discharge valve supported within the body internal cavity coupled to the liquid bladder, the discharge valve including a vertically extending actuation rod; and a bottle having a sport couplable to the mouth aperture and mouth passage for transferring liquid to the internal liquid bladder, the actuation rod having a vent passage therethrough and an upper end, the toy figure body being at least partially deformable by pressure applied thereto whereby the actuation rod is forced downwardly to open the discharge valve allowing the liquid to flow from the body to simulate wetting.

BRIEF OF THE DRAWINGS

Figure 1:
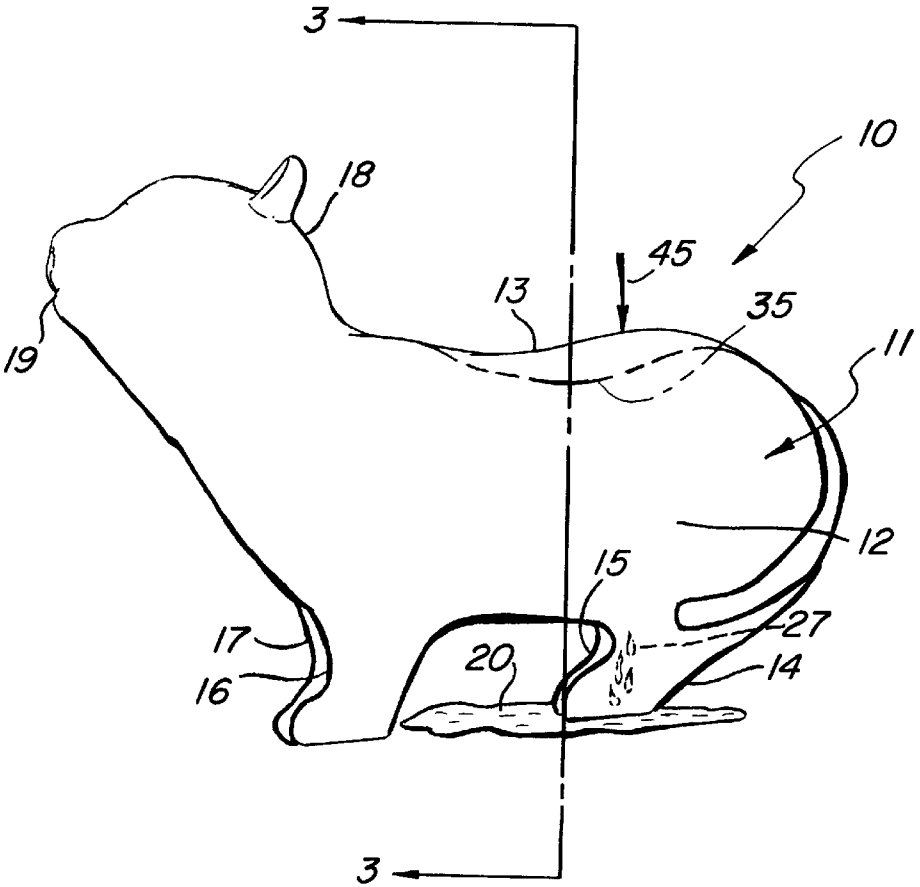
Figure 2:
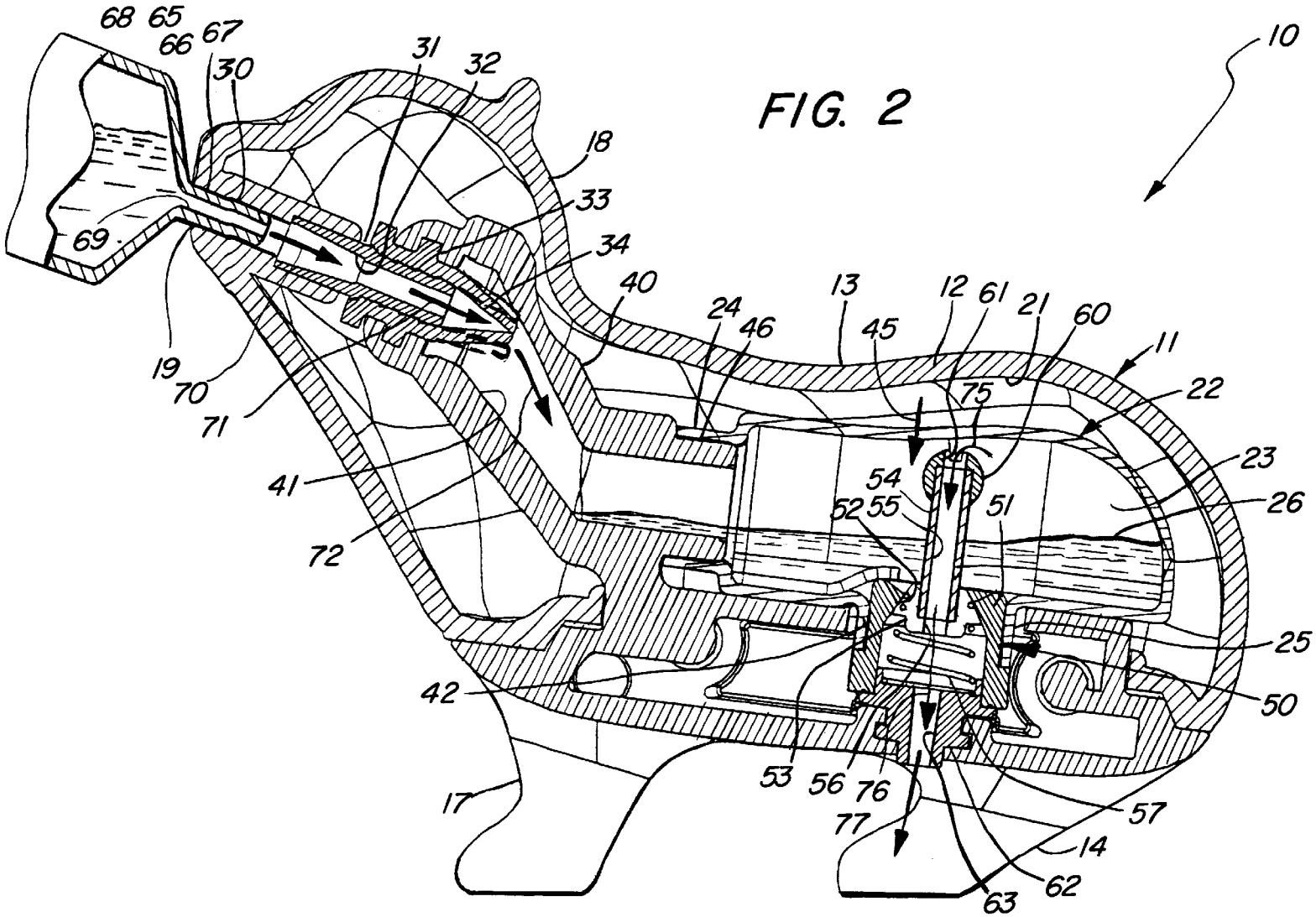

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a side elevation view of a toy animal figure constructed in accordance with the present invention during simulated wetting;

FIG. 2 sets forth a section view of the toy animal figure of FIG. 1 together with a cooperating liquid dispensing bottle showing the toy figure being filled with water;

FIG. 3 sets forth a section view of the present invention animal toy figure taken along section lines 3—3 in FIG. 1.

DESCRIPTION OF THE PREFERRED EMBODIMENT

FIG. 1 sets forth an animal toy figure constructed in accordance with the present invention and generally referenced by numeral 10. Toy FIG. 10 is fabricated having a body 11 generally resembling the body of a cat. However, it will be apparent to those skilled in the art that body 11 may be fabricated to resemble virtually any animal or fanciful depiction of an animal as desired. Accordingly, body 11 includes a torso 12 having a back portion 13 supported by front legs 16 and 17 and rear legs 14 and 15. Body 11 further includes a head 18 supporting a mouth 19. Toy FIG. 10 may be fabricated of virtually any material. However, it is anticipated that materials such as molded plastic or the like may be used for structural elements shown within body 11 as seen in FIGS. 2 or 3. In addition, in the preferred fabrication of the present invention, back 13 of body 11 is fabricated of a somewhat resilient material allowing back 13 to be deformed and deflect downwardly to dashed-line position 35 when the user applies a suitable force upon back 13 in the direction indicated by arrow 45.

In operation, and in accordance with the present invention apparatus set forth below in greater detail, toy FIG. 10 receives a quantity of water which by means also set forth below in greater detail is retained within a liquid bladder 22 (seen in FIG. 2). The liquid within body 11 is retained in the absence of a deflecting force upon back 13. Thus, toy FIG. 10 may be used in accordance with conventional play patterns typical of children playing with such toy figures. In addition and in accordance with the present invention, the application of a downward force upon back 13 in the direction indicated by arrows 45 deflects back 13 downwardly to the configuration shown in dashed-line 35. By means set forth below in greater detail, this deflection of back 13 also operates a discharge valve 50 (seen in FIG. 2) causing a liquid discharge 27 to take place which in turn simulates the wetting action of toy FIG. 10. As discharge 27 continues with the continued pressing upon back 13 by the user, a quantity of wetted liquid 20 collects about rear legs 14 and 15.

While a variety of liquids may be used in combination with toy FIG. 10, the most likely and the preferred liquid to be used is simple tap water or the like. However, water having additional additives such as colorant or the like as desired may be used without departing from the spirit and scope of the present invention.

FIG. 2 sets forth a section view of toy FIG. 10 shown in the absence of the above mentioned wetting action. In addition, FIG. 2 shows an illustration of liquid transfer to the interior of toy FIG. 10 using a water bottle 65. Water bottle 65 is preferably fabricated of a low-cost material such as molded plastic or the like and defines an interior cavity 66 within which a quantity of liquid 68 is confined. Bottle 65 further includes a spout 67 defining a passage 69 therein.

Toy FIG. 10 includes a body 11 within which an interior cavity 21 is formed. Body 11 includes a torso 12 supported by a plurality of legs such as legs 14 and 17. Body 11 further includes a back portion 13, a head 18, a mouth 19 which in turn defines a mouth passage 30.

A coupler 31 defining an interior passage 32 is joined to mouth passage 30 and further supports a valve body 33. Valve body 33 includes a valve mechanism 34 operative to provide single direction liquid flow through valve body 33. Valve body 33 communicates with coupler 31 and is supported within a throat housing 40. Throat housing 40 is supported within interior cavity 21 of body 11 by conventional support means (not shown) and defines an elongated downwardly angled throat passage 41 together with a downwardly open aperture 42. Throat housing 40 further defines a fitting 46 at the interior end of throat passage 41.

A resilient liquid bladder 22 having an interior cavity 23 includes a neck 24 received upon fitting 46 and a downwardly facing neck 25 passing through aperture 42 of throat housing 40.

A vertically oriented discharge valve 50 includes a valve body 51 received within neck 25 in a sealing attachment. Valve body 51 defines a valve seat 52 and is joined to a downwardly facing discharge port 62. The latter defines a discharge passage 63. Discharge valve 50 further includes a movable valve plug 53 supported within valve body 51 by a spring 57. Valve plug 53 is configured to conform generally to a portion of valve seat 52 in a sealing contact. Valve plug 53 is maintained in the raised position shown in FIG. 2 which corresponds to the closed position of discharge valve 50. Valve plug 53 further defines an aperture 56 and receives the lower end of a vertically extending rod 54. Rod 54 is supported by valve plug 53 and defines an interior passage 55. A knob 60 having an aperture 61 formed therein is supported upon the upper end of rod 54.

In operation, and with discharge valve 50 in the closed position shown, bottle 65 is coupled to mouth 19 by the insertion of spout 67 into mouth passage 30 as shown. Once the insertion of spout of 67 within mouth passage 30 is complete, liquid 68 within an interior 66 of bottle 65 begins flowing downwardly through passage 69 and into interior passage 32 of coupler 31 as shown by arrows 70. The downward flow of liquid 68 is sufficient to force valve 34 open allowing a further flow of liquid through valve 34 as indicated by arrows 71. The flowing liquid continues down through throat passage 41 as indicated by arrows 72 and thereafter accumulates within interior cavity 23 of liquid bladder 22 accumulating as a quantity of liquid 26.

Once the user has completed the desired filling of interior cavity 23 of liquid bladder 22, body 65 is removed from mouth 19 as spout 67 is withdrawn from mouth passage 30. In accordance with the conventional operation of valve 34, liquid 26 is prevented from interior 23 through throat passage 41 by the closure of valve 34.

In the absence of actuation of discharge valve 50, liquid 26 continues to be retained within interior cavity 23 of bladder 22 for an indefinite period of time. Once the user decides to actuate the wetting function of toy FIG. 10, the user simply presses downwardly upon back 13 with sufficient force to deflect back 13 downwardly in the manner shown in FIG. 1. The downward deflection of back 13 causes a corresponding deflection of liquid bladder 22. The downward deflection of liquid bladder 22 allows the transfer of downward force to knob 60 forcing rod 54 downwardly in the direction indicated by arrow 45. The downward movement of rod 54 is achieved by overcoming the force of spring 57 such that valve plug 53 is moved correspondingly downward. Once valve plug 53 is displaced downwardly, the seal between valve plug 53 and valve seat 52 is released allowing liquid 26 to flow downwardly between valve seat 52 and valve plug 53. This downward flow passes through the interior of valve body 51 and discharge passage 63 of discharge port 62 as indicated by arrow 77. Thus, the flow of liquid 26 outwardly through discharge port 62 continues so long as the user maintains sufficient force upon back 13 to displace rod 54 and valve plug 53 downwardly.

Once the user releases the downward force upon back 13, the resilience of the material forming back 13 as well as the resilience forming the material of liquid bladder 22 allow each to return to the natural shape shown in FIG. 2. In addition, in the absence of force upon knob 60, spring 57 again returns valve plug 53 to the sealed position shown in which valve plug 53 is seated against valve seat 52 preventing further liquid flow.

At any point, the user may choose to reinsert spout 67 of bottle 65 and transfer additional liquid to interior 23 of liquid bladder 22. In accordance with an important aspect of the present invention, it will be noted that the cooperation of aperture 61, passage 55 of rod 54, and discharge passage 63 of discharge port 62 cooperate to provide an air vent by which air trapped within interior cavity 23 of bladder 22 may be forced outwardly as indicated by arrows 75, 76 and 77 to vent the interior of bladder 22. This venting of bladder 22 is critical to the process of refilling the quantity of liquid 26 therein. The extension of rod 54 above the anticipated surface of liquid 26 prevents liquid flow through aperture 61 and passage 55. Thus, bladder 22 remains capable of securely holding liquid 26 and remains properly vented to allow refilling and discharge of liquid in the above described manner.

FIG. 3 sets forth a section view of toy FIG. 10 taken along section lines 3-3 in FIG. 1. Toy FIG. 10 includes a body 11 having a torso 12 supported by front legs 16 and 17. Torso 12 further defines an interior cavity 21 within which a resilient liquid bladder 22 is supported. Bladder 22 defines an interior cavity 23 and a downwardly open neck 25. Neck 25 is received within aperture 42 of throat housing 40. Liquid bladder 22 further includes a neck 24 (seen in FIG. 2) received upon a throat fitting 46 formed in throat housing 40. Throat housing 40 further defines a throat passage 41.

What has been shown is a novel animal toy figure having a simulated liquid drinking and wetting action which is carried forward with a simple but effective discharge mechanism. The animal toy figure is readily filled by a conventional liquid bottle having a supply of convenient liquid such as water or the like. A liquid bladder within the toy figure receives and securely contains the ingested quantity of liquid until the wetting action is initiated. The entire mechanism is capable of fabrication using conventional low-cost mass-produce components such as molded plastic components and the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a deformable toy figure body having a head defining a mouth aperture and mouth passage and having a body interior cavity;

an internal liquid bladder supported within said body interior cavity;

means for coupling said mouth passage to said liquid bladder;

a discharge valve supported within said body internal cavity coupled to said liquid bladder, said discharge valve including a vertically extending actuation rod; and a bottle having a spout couplable to said mouth aperture and mouth passage for transferring liquid to said internal liquid bladder, said actuation rod having a vent passage therethrough and an upper end, said toy figure body being at least partially deformable by pressure applied thereto whereby said actuation rod is forced downwardly to open said discharge valve allowing said liquid to flow from said body to simulate wetting.

2. The toy figure set forth in claim 1 wherein said discharge valve includes a movable valve plug joined to said actuation rod and defining a vent aperture communicating with said vent passage in said actuation rod, said vent passage and said vent aperture cooperating to vent air from said liquid bladder during filling of said liquid bladder.

3. The toy figure set forth in claim 2 wherein said means for coupling includes a single flow direction valve allowing liquid to flow into said liquid bladder and preventing opposite direction flow.

4. The toy figure set forth in claim 3 wherein said body includes a deformable back portion and wherein said upper end of said actuation rod is positioned beneath said deformable back portion.

5. The toy figure set forth in claim 1 wherein said means for coupling includes a single flow direction valve allowing liquid to flow into said liquid bladder and preventing opposite direction flow.

6. The toy figure set forth in claim 1 wherein said body includes a deformable back portion and wherein said upper end of said actuation rod is positioned beneath said deformable back portion.

7. A toy figure comprising:

a deformable toy figure body;

a liquid bladder supported within said body;

a discharge valve supported by said body, said discharge valve including, a valve body defining a valve seat, a discharge port, a valve plug having a seal fitting said valve seat and defining a vent aperture therethrough, a valve spring urging said valve plug against said valve seat to close said discharge valve, an actuation rod secured to said valve plug having an upper end and a vent passage therethrough, said vent passage and said vent aperture cooperating to vent air from said liquid bladder when said discharge valve is closed to facilitate filling of said liquid bladder.

* * * * *